US005457468A

United States Patent [19]

Saldell

[11] Patent Number: 5,457,468

[45] Date of Patent: Oct. 10, 1995

[54] AUTOMOBILE ANTENNA

[75] Inventor: Ulf Saldell, Österskär, Sweden

[73] Assignee: Allgon AB, Akersberga, Sweden

[21] Appl. No.: 961,690

[22] PCT Filed: Jul. 5, 1991

[86] PCT No.: PCT/SE91/00480

§ 371 Date: Jan. 6, 1993

§ 102(e) Date: Jan. 6, 1993

[87] PCT Pub. No.: WO92/01318

PCT Pub. Date: Jan. 23, 1992

[30] Foreign Application Priority Data

Jul. 6, 1990 [SE] Sweden ..... 9002383

[51] Int. Cl.[6] ..... H01Q 1/32

[52] U.S. Cl. ..... 343/715; 343/864

[58] Field of Search ..... 343/713, 715, 343/850, 864, 862, 860; H01Q 1/32

[56] References Cited

U.S. PATENT DOCUMENTS 4,839,660 6/1989 Hadzoglou ..... 343/715
4,875,051 10/1989 Blaese ..... 343/715
4,882,592 11/1989 Studer, Jr. et al. ..... 343/715
4,916,456 4/1990 Shyu ..... 343/713
4,931,806 6/1990 Wunderlich ..... 343/715
4,999,642 3/1991 Wells ..... 343/860

*Primary Examiner*—Michael C. Wimer
*Attorney, Agent, or Firm*—Jacobson, Price, Holman & Stern

[57] ABSTRACT

An antenna is mounted on a window of a vehicle and includes an antenna rod (6) fastened to an electrically conductive base (1) mounted on the outside of the window, and a connection member on the inside of the window directly opposite the base. An antenna lead from the vehicle's radio is connected to the connection member, which comprises a box (8) with an earth plane and is mounted on the window with a conductive plate (12). A connection conductor (13) between the plate (12) and the antenna lead (15) has an electrical length of (¼+n×½) times the wavelength of operation, where n=0 or a whole number. The surface exposed by the conductor (13) is spaced from the earth plane (16) so as to define a characteristic impedance for the conductor (13), so that the impedance at the antenna feed point together with the capacitive coupling through the window is transformed into an impedance equal to that of the antenna lead.

1 Claim, 1 Drawing Sheet

AUTOMOBILE ANTENNA

SUMMARY OF THE INVENTION

The present invention relates to an antenna assembly for radio and communication apparatus in vehicles, where the assembly is mounted against a pane, i.e. any one of the glass windows, pertaining to the vehicle, and includes an antenna rod fixed to an electrically conductive base, which is mounted on the outside surface of the pane, a connection member coacting with the base and placed on the inside of the pane directly opposite the base, there being a coaxial antenna lead from the vehicle's radio or communication apparatus connected to this member, which comprises a box of at least partially electrically conductive material, with its open side facing towards the base, the box being mounted on the plane with the aid of a non-conductive plate or disk enclosing the open side of the box, the conductor of the antenna lead being insulated from the box and having a connection conductor to a plane opposing the inside of the pane, this plane being situated at the covering disk directly opposite the base.

The object of the present invention is to simplify the connection conductor between the antenna lead and the opposing plane, so that no special means such as adjustable capacitances or the like need be arranged inside the box. The known art is explained, e.g. in U.S. Pat. No. 4,839,660.

BRIEF DESCRIPTION OF THE DRAWINGS

An embodiment of the invention, together with an alternative implementation of a connection conductor pertaining thereto will now be described in the following as exemplifications of the invention, reference also being made to the accompanying drawing figures, where.

DESCRIPTION OF THE PREFERRED EMBODIMENT

Figure 1:
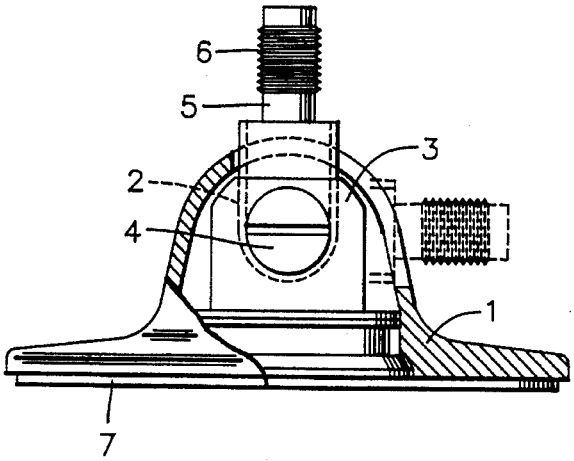
FIG. 1 is a side view, in partial section, of a fixing for an antenna rod.

The fixing (see FIG. 1) for the antenna rod comprises a circular base 1. At its central portion the base has upstanding lugs 2,3 between which the lower end of the rod is mounted with the aid of a journaling pin 4, such as to enable the rod to swing about the pin from an upright position to a position at 90° thereto, the former being illustrated with full lines and the latter with dashed lines in the figure.

The rod is preferably mounted between the lugs 2,3 such as to coact with the pin 4 via the stub shaft 5 provided with a thread 6 for mating with an internal thread in the rod.

Figure 2:
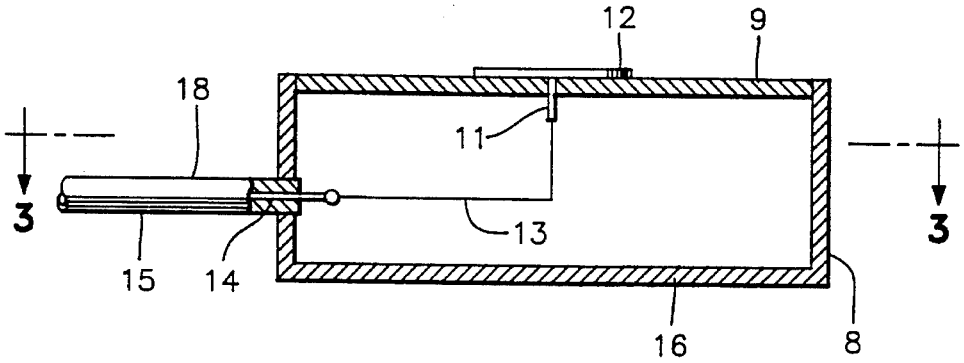
FIG. 2 is a schematic section of the connection member mounted on the inside of the plane.

The base 1 includes a disk or the like of electrically conductive material and is mounted on the outside of the pane, e.g. using double-sided adhesive tape 7. Impedance, antenna lobe and efficiency are determined by the length and appearance of the antenna and the base 1. The connection member comprising a box 8 of at least partially electrically conductive material is to form, together with the base on the outside of the plane, the connection for carrying radio waves from and to the antenna to and from a communication radio in the vehicle via an antenna lead. The box has an open side facing towards the inside of the pane and is situated directly opposite the base 1. In FIG. 2 this one side is enclosed by a disk 9, of dielectric material, which may be provided with unillustrated, double-sided tape. A pin 11 passes through the center of the disk 9, and is in communication with a disk 12, which provides an opposing plane to the base 1. There is thus obtained a capacitance connection between the base and the disk 12.

The pin 11 is connected to a connection conductor 13, which extends into contact with the conductor 14 of an antenna lead 15, the latter conductor being insulated from the box 8. The other end of the lead is connected to the communication apparatus in the vehicle.

The intention with the connection conductor 13 is that it will be a simple electrical conductor, not requiring any other connection parts or electrical means in the box. The impedance of the conductor 13 must therefore be adjusted such that the impedance in the antenna lead 15 is in agreement with the impedance in the antenna and base 1. If ideal conditions prevail at the box and at the ends of the conductor 13, then the length of the latter will be the critical dimension. The following applies in principle: $l=k\times\frac{1}{4}\lambda$. If the frequency is now put at 1000 MHz then $\lambda$ will be approximately 300 mm. The length of the conductor will then be $k\times\frac{1}{4}\times300=k\times75$ mm. Normally, k is made somewhat less than or equal to 1. This results in that the connection conductor will be approximately 75 mm long in the example given here. The quotient ¼ can be enlarged by an added whole number factor of ½, the factor ¼ then becoming ¾, ⁵⁄₄ etc.

Figure 3:
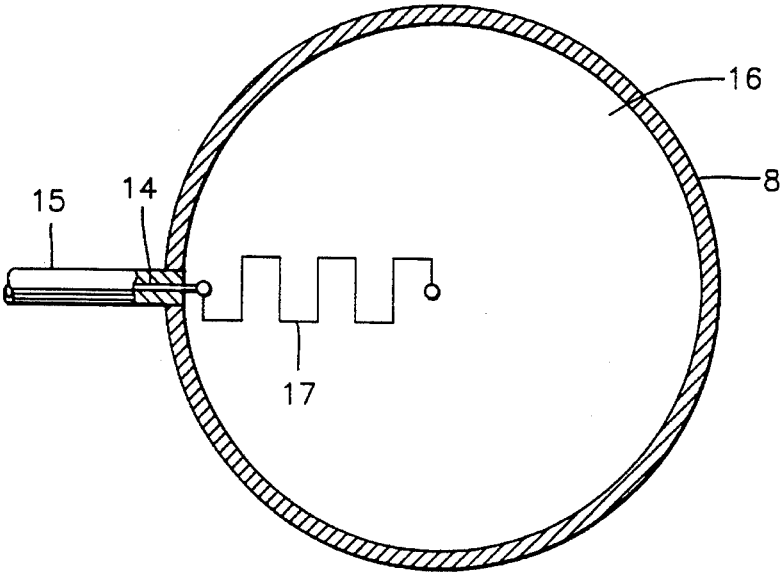
FIG. 3 is a cross section along the line III—III in FIG. 2 of a connection member having an alternative embodiment of the connection conductor.

It is well-known that the factor ¼ may be affected by extraneous conditions such as stray capacitances, stray/leakage inductances and undesired series or parallel resistances. The quotient ¼ may then be given other values, e.g. 0.23, 0.26 or similar, in the vicinity of 0.25. Let it be assumed that the bottom 16 of the box 8 is of conductive material, and may thus be said to constitute an earth plane. The electrically conductive sheath 18 of the antenna lead is conductively connected to the bottom 16. It will therefore be important to situate the conductor 13 at a given distance from the earth plane 16. Furthermore, in an alternative implementation of the connection conductor 13, as will be seen in FIG. 3, the conductor has been given a wave form to obtain a desired length, and is denoted by the numeral 17. It has thus been given a characteristic impedance, and in calculation the conductor surface exposed to the earth plane 16 shall be a given distance to the plane 16. There must be taken into account here any unintentional stray capacitances, stray/leakage inductances and series or parallel resistances. Alternatively, the earth plane may be formed using a separate metal plane or metal wire situated in the box and in the conductive communication with the sheath 18 of the antenna lead.

I claim:

1. Antenna assembly for communication apparatus in a vehicle, where the assembly is mounted against a plane of the vehicle, and includes an antenna rod fixed to an electrically conductive base, which is mounted on the outside surface of the pane, a connection member coacting with the base and placed on the inside of the pane directly opposite the base, there being a coaxial antenna lead from the communication apparatus connected to the connection member, which connection member comprises a box with a mouth facing towards the base, the box being mounted on the pane by means of a non-conductive plate covering the mouth of the box, which connection member also includes an earth plane connected to a conductive outer sheath of the coaxial antenna lead, the coaxial antenna lead having a conductor insulated from the box and connected to one end of a connection conductor having an opposite end connected to a conductive plate sandwiched between said non-conductive plate and an inside surface of the pane, characterized in that the connection conductor has an electrical length of ($\frac{1}{4}+n\times\frac{1}{2}$) times the wavelength of a desired transceiver frequency, or the wavelength at a point within a given frequency range, where n=0 or a whole number, and in that the connection conductor has an exposed surface with a spacing from said earth plane to provide the connection conductor with a characteristic impedance which is such that the impedance at the conductive plate together with the capacitive couple through the pane including any unintentional stray capacitances, stray/leakage inductances and undesired series or parallel resistances matches the impedance of the antenna lead between the box and the communication apparatus.

* * * * *